United States Patent [19]

Haythornthwaite

[11] Patent Number: 4,597,576

[45] Date of Patent: Jul. 1, 1986

[54] SPORTS RACQUET UTILIZING NON-CIRCULAR STRINGS

[76] Inventor: James Haythornthwaite, 567 Main Road, Hudson, Quebec, Canada, J0P 1J0

[21] Appl. No.: 628,993

[22] Filed: Jul. 9, 1984

[51] Int. Cl.[4] ..... A63B 51/00

[52] U.S. Cl. ..... 273/73 D

[58] Field of Search ..... 273/73 D, 73 E, 73 R; D21/212

[56] References Cited

U.S. PATENT DOCUMENTS

| | | | |
|---|---|---|---|
| 1,252,576 | 1/1918 | Hutchinson | 273/73 E |
| 1,476,906 | 12/1923 | Santa Maria | 273/73 E |
| 1,531,778 | 3/1925 | Gallaudet . | |
| 1,694,360 | 12/1928 | Larned . | |
| 2,080,642 | 5/1937 | Timpe | 273/73 |
| 2,847,790 | 8/1958 | Tjernagel | 43/11 |
| 2,969,984 | 1/1961 | Presnick | 273/73 |
| 3,744,529 | 7/1973 | Jorda et al. | 138/25 |
| 3,926,431 | 12/1975 | DeLorean | 273/73 D |
| 4,005,863 | 2/1977 | Henry | 273/73 D |
| 4,013,290 | 3/1977 | Stevens | 273/73 E |
| 4,163,553 | 8/1979 | Renfro | 273/73 D |
| 4,377,288 | 3/1983 | Sulprizio | 273/73 D |
| 4,462,591 | 7/1984 | Kenworthy | 273/73 D |

FOREIGN PATENT DOCUMENTS

| | | | |
|---|---|---|---|
| 2513567 | 7/1976 | Fed. Rep. of Germany | 273/73 E |
| 22409 | 8/1932 | Netherlands | 273/73 D |
| 234021 | 9/1925 | United Kingdom | 273/73 D |
| 428582 | 5/1935 | United Kingdom | 273/76 |

*Primary Examiner*—Richard C. Pinkham
*Assistant Examiner*—Matthew L. Schneider
*Attorney, Agent, or Firm*—Fleit, Jacobson, Cohn & Price

[57] ABSTRACT

A sports racquet which utilizes non-circular strings is disclosed. The strings are threaded to the racquet in the normal manner with their flat or larger surfaces facing outwardly. The strings are thus arranged in a grid pattern with their flat or larger surfaces forming the striking area.

1 Claim, 4 Drawing Figures

SPORTS RACQUET UTILIZING NON-CIRCULAR STRINGS

BACKGROUND OF THE INVENTION

This invention relates to a sports racquet which utilizes non-circular strings.

The sports racquets existing today utilize round strings in forming their net. Because their striking area is comprised of round strings, these racquets exhibit several shortfalls. For instance, the strings slide over one another on contact with an object, thereby reducing string life and causing the strings to vary from their original grid pattern. Also, because the strings have a limited cross-sectional area, their elasticity is limited, thereby reducing the amount of tension which may be applied during stringing of the racquet. Finally, because the strings have limited surface contact with the ball, the racquet provides limited ball control.

Accordingly, it is an object of this invention to provide a sports racquet whose strings remain in their original grid pattern and experience a longer effective life by virtue of their resistance to movement over one another.

Another object of this invention is to provide a tennis racquet whose strings have a greater cross-sectional area, thereby improving their elasticity and allowing greater tension to be applied during stringing.

Another object of this invention is to provide a racquet which provides for improved ball control by virtue of greater string surface contact with the ball.

Still another object of this invention is to provide a racquet with strings which better maintain tension during play.

SUMMARY OF THE INVENTION

The foregoing and other objects of the invention are achieved by providing a sports racquet which utilizes non-circular strings. The strings are threaded to the racquet head in the normal manner with their flat or larger surfaces facing outwardly. The strings are thus arranged in a grid pattern with their flat or larger surfaces forming the striking area.

DETAILED DESCRIPTION OF THE PREFERRED EMBODIMENT

Figure 1:
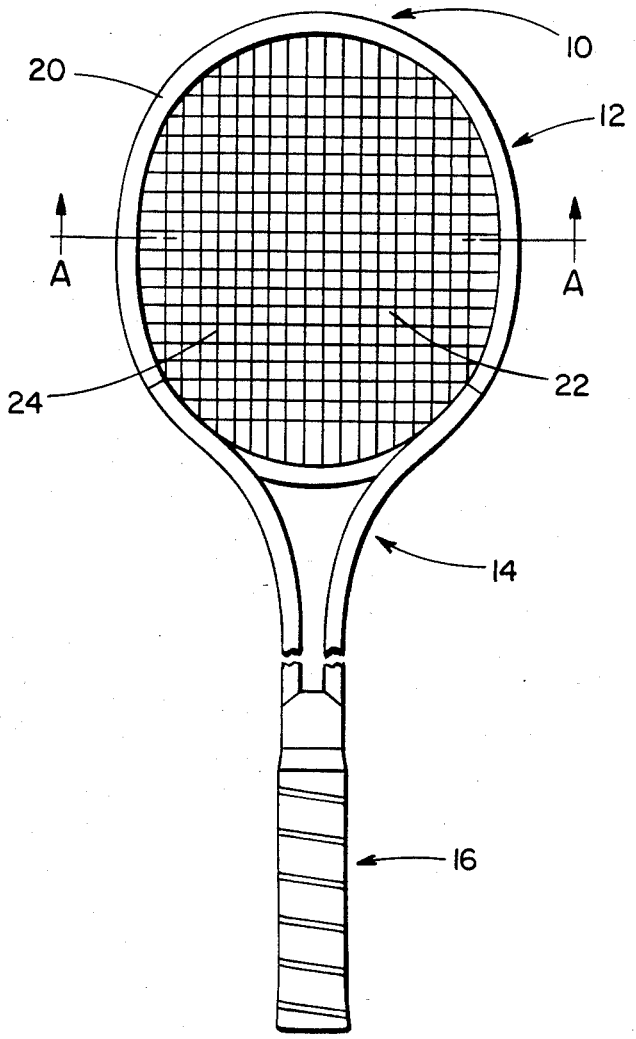
FIG. 1 is a plan view of the racquet of the present invention.

Referring now to FIG. 1, the sports racquet of the present invention is shown generally at 10. Racquet 10 comprises a head portion 12, a neck portion 14, and a handle portion 16.

Head portion 12 comprises a racquet frame 20 which defines a central opening 22. Attached to frame 20 and forming a net in the central opening 22 are strings 24. Frame 20 may employ a plurality of individual strings 24, each spanning the opening 22 in either the horizontal, vertical, or diagonal direction and being securely attached to frame 20. Alternately, the frame 20 may employ a small number of strings 24, or even a single string 24, continuously threaded to the frame 20.

Strings 24 are non-circular in shape and are attached to frame 20 such that their flat or larger surfaces face outwardly, thereby forming the striking area. While strings 24 are rectangular in the preferred embodiment, other non-circular shapes are also envisioned to be within the scope of the present invention.

Because strings 24 are non-circular, there is more frictional impedance between strings 24 which cross one another. Because racquet 10 thus reduces wear caused by sliding, strings 24 experience a longer effective life and are more likely to remain in their original grid pattern upon impact. In addition, because strings 24 have a greater cross-sectional area than conventional circular strings of the same size, strings 24 have greater strength and better elastic qualities. As a result, greater tension can be applied at stringing and will be maintained during play. Finally, because the flat or larger surfaces of strings 24 face outwardly, racquet 10 provides for greater surface contact with a ball (not shown) and, thus, better ball control.

Figure 2:
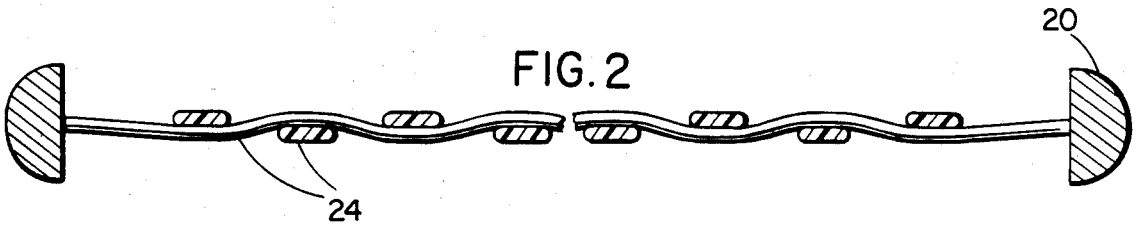
FIG. 2 is a cross-sectional view taken along line A—A of FIG. 1 wherein the racquet employs rectangular strings.
Figure 3:
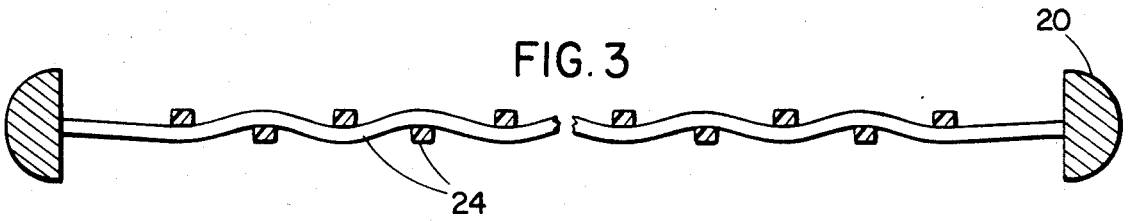
FIG. 3 is a cross-sectional view taken along line A—A of FIG. 1 wherein the racquet employs square strings.
Figure 4:
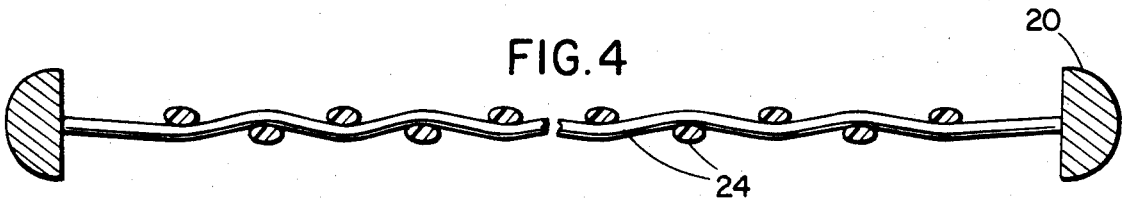
FIG. 4 is a cross-sectional view taken along line A—A of FIG. 1 wherein the racquet employs elliptical strings.

FIGS. 2 through 4 illustrate alternate embodiments of the present invention wherein strings of different cross-sectional shapes are used.

Although a particular embodiment of the present invention has been illustrated and described, it will be apparent to those skilled in the art that various changes and modifications can be made without departing from the spirit and scope of the present invention. It, therefore, is the intent to encompass within the appended claims all such changes and modifications that fall within the scope of the present invention.

What is claimed is:

1. A tennis racquet comprising:

an annular head portion defining a central opening;

an elongated handle portion;

a neck portion connecting said head portion and said elongated handle portion;

said annular head portion, said elongated handle portion and said neck portion defined by a tennis racquet frame;

strings attached to said tennis racquet frame, said strings having a non-twisted configuration along their lengths, and said strings being interwoven to cross each other and form a single grid pattern within said central opening such that said strings form crossover points;

substantially all of said strings of said single grid pattern having an elliptical cross-sectional shape; and said single grid pattern being formed such that at said crossover points, the largest peripheral side surface of one of said strings engages the largest peripheral side surface of a crossing string at each crossover point formed by said single grid pattern for resisting sliding movement of one string over another due to frictional impedance caused by said elliptical cross-sectional shape, said peripheral side surfaces of said strings being located in said single grid pattern to form two opposed hitting surfaces, the peripheral side surfaces of said strings forming said hitting surfaces being the largest peripheral side surface of said strings for maximum string to ball surface contact area.

* * * * *